US006699048B2

(12) United States Patent
Johnson et al.

(10) Patent No.: US 6,699,048 B2
(45) Date of Patent: Mar. 2, 2004

(54) HIGH DENSITY CONNECTOR

(75) Inventors: L. Robin Johnson, Liverpool, PA (US); William E. Spink, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/047,174

(22) Filed: Jan. 14, 2002

(65) Prior Publication Data

US 2003/0134527 A1 Jul. 17, 2003

(51) Int. Cl.[7] ..... H01R 12/00
(52) U.S. Cl. ..... 439/74; 439/83
(58) Field of Search ..... 439/83, 74, 66, 439/71

(56) References Cited

U.S. PATENT DOCUMENTS

| | | | | |
|---|---|---|---|---|
| 4,793,816 | A | 12/1988 | Pittman et al. | 439/79 |
| 5,026,295 | A | 6/1991 | Fong et al. | 439/135 |
| 5,215,474 | A | 6/1993 | Rotella | 439/149 |
| 5,637,019 | A | 6/1997 | Crane, Jr. et al. | 439/677 |
| 5,692,917 | A | 12/1997 | Rieb et al. | 439/225 |
| 5,746,622 | A | 5/1998 | Consoli et al. | 439/521 |
| 5,876,217 | A | 3/1999 | Ito et al. | 439/74 |
| 5,888,101 | A | 3/1999 | Dent et al. | 439/680 |
| 5,975,921 | A | 11/1999 | Shuey | 439/83 |
| 6,024,584 | A | 2/2000 | Lemke et al. | 439/83 |
| 6,079,991 | A | 6/2000 | Lemke et al. | 439/83 |
| 6,093,035 | A | 7/2000 | Lemke et al. | 439/83 |
| 6,164,983 | A | 12/2000 | Lemke et al. | 439/83 |
| 6,193,523 | B1 * | 2/2001 | Harper, Jr. | 439/66 |
| 6,241,536 | B1 | 6/2001 | Shuey | 439/83 |
| 6,409,521 | B1 * | 6/2002 | Rathburn | 439/66 |

* cited by examiner

*Primary Examiner*—Alexander Gilman
(74) *Attorney, Agent, or Firm*—Harrington & Smith, LLP

(57) ABSTRACT

A high density connector comprises a receptacle housing having a base wall and at least one lateral wall defining a cavity. The lateral wall is configured to nest within a plug housing. A high density array of female electrical contacts is arranged in the cavity which are supported in the base wall and extend unsupported above the base wall to a given height. A single piece protection member is arranged in the cavity adjacent the base wall. The protection member has an array of openings in which the electrical contacts extend. The protection member has a thickness selected so that the electrical contacts do not extend beyond an outer face of the protection member.

19 Claims, 11 Drawing Sheets

HIGH DENSITY CONNECTOR

BACKGROUND OF THE INVENTION

1. Field of the Invention

The present invention relates to electrical connectors and more particularly to high I/O density connectors, having a low-mated height.

2. Brief Description of Prior Developments

The drive to reduce the size of electronic equipment, particularly personal portable devices, and to add additional functions to such equipment, has resulted in an ongoing drive for miniaturization of all components, especially electrical connectors. Efforts to miniaturize connectors have included reducing the pitch between terminals in single or double row linear connectors, so that a relatively high number of I/O or other lines can be interconnected by connectors that fit within tightly circumscribed areas on the circuit substrates allotted for receiving connectors. The drive for miniaturization has also been accompanied by a shift in preference to surface mount techniques (SMT) for mounting components on circuit boards. The confluence of the increasing use of SMT and the required fine pitch of linear connectors has resulted in approaching the limits of SMT for high volume, low cost operations. Reducing the pitch of the terminals increases the risk of bridging adjacent solder pads or terminals during reflow of the solder paste.

To satisfy the need for increased I/O density, array connectors have been proposed. Such connectors have a two dimensional array of terminals mounted on an insulative substrate and can provide improved density. However, these connectors present certain difficulties with respect to attachment to the circuit substrates by SMT techniques because the surface mount tails of most, if not all, of the terminals must be beneath the connector body. As a result, the mounting techniques used must be highly reliable because it is difficult to visually inspect the solder connections or repair them, if faulty.

Another problem presented in soldering connectors to a substrate is that connectors often have insulative housings which have relatively complex shapes, for example, ones having numerous cavities. Residual stresses in such thermoplastic housings can result from the molding process, from the build up of stress as a result of contact insertion, or a combination of both. These housings may become warped or twisted either initially or upon heating to temperatures necessary in SMT processes, such as temperatures necessary to reflow the solder balls. Such warping or twisting of the housing can cause a dimensional mismatch between the connector assembly and the PWB, resulting in unreliable soldering because the surface mounting elements, such as solder balls, are not sufficiently in contact with the solder paste or close to the PWB prior to soldering.

U.S. Pat. Nos. 6,024,584, 6,093,035, 6,079,991, 6,164,983, 6,241,535, all to Lemke et al. and U.S. Pat. Nos. 5,975,921, 6,241,536 all to Shuey, all assigned to the assignee of the present invention, are directed to solutions to these design challenges. The Lemke et al. patents and the Shuey patent are specifically incorporated by reference herein, in their entirety. The drive for reduced connector size relates not only to footprint dimensions but also to mated connector height. As electrical equipment shrinks in size, the necessity arises for stacking circuit boards closer together. This invention concerns high density connectors, particularly low profile connectors for reducing the spacing between stacked circuit boards. The Lemke et al. 584', 035', 991', and 983' patents each show a receptacle connector without a peripheral wall. The receptacle has a snap on plate for protecting female electrical contacts which otherwise would extend above the base of the receptacle.

U.S. Pat. Nos. 5,692,917, 5,746,622 and 5,888,101, illustrate the use of certain types of inserts in electrical connectors. U.S. Pat. No. 5,215,474, shows a certain protector design surrounding pins of a connector. U.S. Pat. No. 5,026,295, shows a certain cover for protecting terminals. U.S. Pat. No. 5,876,217, shows terminals recessed beneath connector housings. U.S. Pat. No. 4,793,816, discloses a two piece protector for use with a connector having exposed terminals. U.S. Pat. No. 5,637,019, shows an electrical connector with exposed electrical contacts.

There is a need for electrical connectors with high I/O (input/output) density and a low profile, which also provide excellent thermal stability during soldering.

SUMMARY OF THE INVENTION

Electrical connectors according to the present invention provide high I/O density and a low profile for providing reduced stacking height between circuit boards and improved thermal stability during soldering to a circuit board.

In accordance with a preferred embodiment of this invention, a high density connector comprises a receptacle housing having a base wall and at least one lateral wall defining a cavity. The lateral wall is configured to nest within a plug housing. A high density array of female electrical contacts is arranged in the cavity which are supported in the base wall and extend unsupported above the base wall to a given height. A single piece protection member is arranged in the cavity adjacent the base wall. The protection member has an array of openings in which the electrical contacts extend. The protection member has a thickness selected so that the electrical contacts do not extend beyond an outer face of the protection member.

The electrical contacts deflect upon insertion of a corresponding male contact of the plug housing and the openings are configured to permit full operation of the contacts including such deflection. The protection member preferably comprises a plate like member which is in contact with the base wall of the receptacle.

In accordance with a further preferred embodiment of this invention the at least one lateral wall of the receptacle housing includes at a free edge thereof a guide surface for guiding the receptacle housing into a cavity of the plug housing and the connector further includes a plug housing having a base wall and at least one lateral wall defining a cavity. The lateral wall of the plug housing is preferably configured receive the lateral wall of the receptacle housing in a nested configuration. A high density array of male electrical contacts is arranged in the plug housing cavity. The male contacts are supported in the base wall of the plug housing and extending unsupported above the base wall to a desired height so that when the receptacle housing is nested in the plug housing the male contacts are engaged with the female contacts.

BRIEF DESCRIPTION OF THE DRAWINGS

The method and connector of the present invention is further described with reference to the accompanying drawings in which.

DETAILED DESCRIPTION OF THE PREFERRED EMBODIMENTS

While the present invention will hereinafter be described in connection with preferred embodiments thereof, it will be understood that it is not intended to limit the invention to that embodiment. On the contrary, it is intended to cover all alternatives, modifications and equivalents as may be included within the spirit and scope of the invention as defined by the appended claims.

Figure 1:
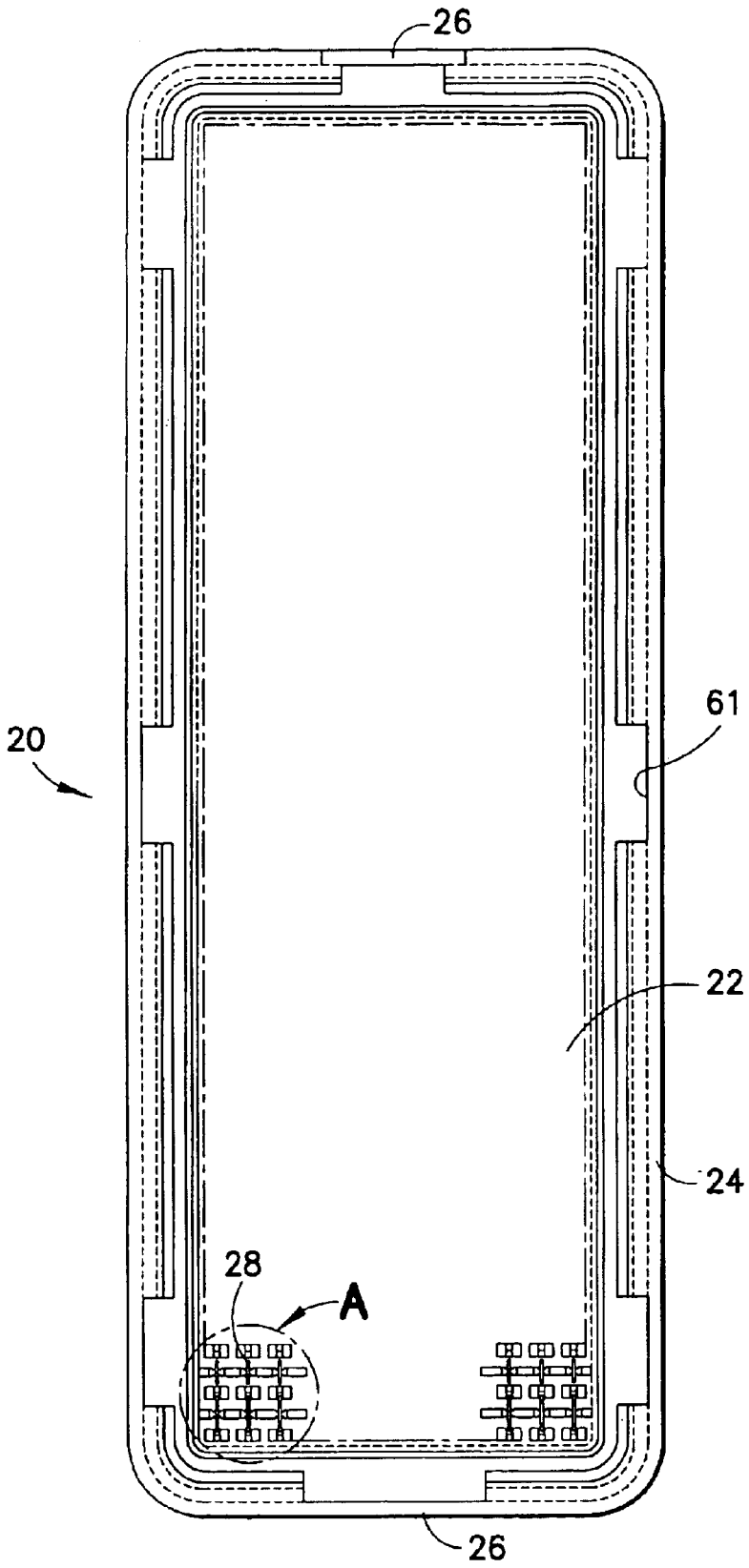
FIG. 1 is a top plan view of a plug connector embodying the present invention.

FIG. 1 shows an exemplary embodiment of a plug connector 20 which has been modified compared to the plug connector described in U.S. Pat. No. 6,241,535, which is incorporated by reference herein in its entirety. The plug connector 20 has a connector body or housing comprising a substantially planar base member 22 and at least one lateral wall 24. Preferably the wall 24 is a unitary surrounding peripheral wall 24 although it could be made up of one or more segments. On each end wall there are polarizing/alignment slots 26 upstanding from the wall 24 to assure proper mating of the plug connector 20 with its companion receptacle connector 52, described later. Preferably the connector body is formed as an integral one piece part by molding an insulative polymer. Preferably, the polymer is one capable of withstanding SMT (Surface Mount Technology) reflow temperatures, for example, a liquid crystal polymer.

The plug connector 20 includes an array of plug contact terminals 28 that are retained in a desired pattern, such as a two dimensional matrix or array, on the connector base 22. For purposes of simplicity of the drawing, only a few of the terminal sites are shown.

Figure 3:
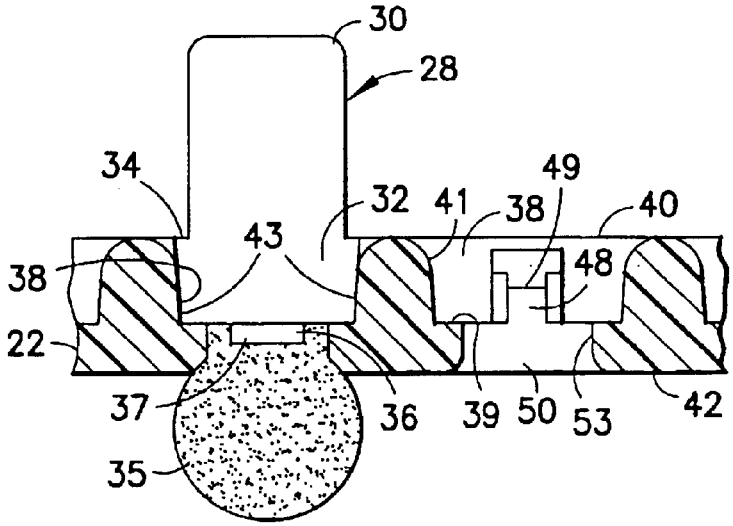
FIG. 3 is a cross section of the area shown in FIG. 2 taken in the direction of line 3—3 in FIG. 2.

Referring to FIG. 3, in accordance with this preferred embodiment each plug terminal 28 comprises a substantially planar contact terminal having a mating section 30 for mating with a receptacle contact terminal 72, to be later described. Plug terminal 28 also includes a retention section 32 adapted to be retained in the connector base or body 22 in a manner that will hereinafter be described. The retention section 32 includes a pair of opposed shoulders 34 against which an insertion tool is applied to insert the terminal 28 into a terminal passage 38 formed in the connector body 22. Burrs or barbs (not shown) can also be formed at shoulders 34 to aid in retention of the terminal in the passage 38. A solder tab 36 extends from the retention section 32 through slot-shaped opening 53 at the bottom of the passage 38 and is adapted to have a fusible substrate contact mass or body, such as solder ball 35, fused thereon. Preferably, the lead edge of the solder tab is beveled toward its tip on one or both sides of the terminal, as by chamfer or bevel 37. Solder balls 35 are fused onto plug terminals 28 and receptacle terminals 72 (described later) by techniques described in the Lemke et al. and Shuey patents noted previously in the Background section. As illustrated in FIG. 3, the contact terminal 28 is retained in the terminal passage 38 formed in the connector body 22. The passage 38 extends from a mating interface or surface 40 toward a mounting surface 42. A recess such as a well or pocket 50 is formed in the mounting surface 42 in alignment and communication with each passage 38 through slot opening 53. The mating contact section 30 extends outwardly from the mating interface 40. The solder tab 36 extends into the pocket 50.

The terminal 28 is positioned substantially in alignment with a medial plane MP (FIG. 2) of the passage 38. The terminal contacts 28 are secured in the body 22 in a manner to avoid the inducing of stress into the molded plastic body upon insertion of the terminals. This objective is achieved in the preferred embodiment by the utilization of the opposed projections 48. A lead-in surface 49 is formed at the top of each projection 48. The distance between the distal portions of the projections 48 is less than the thickness of the metal terminal 28 thereby creating an interference fit. Thus the distal portion of each projection 48 is engaged and deformed by the contact terminal as the terminal 28 is inserted into the passage 38 and slot 53. Preferably, the distal positions of projections 48 are spaced equidistant from the medial plane MP, so that there is substantially equal amounts of deformation of each projection upon insertion of the terminal. As a result, the normal forces against terminal retention section 32 are substantially balanced, thereby aiding in alignment along medial plane MP. The contact terminal is securely held in the passage 38 and slot 53 by the normal force exerted on the contact terminal by the deformed projections. The lead-in surfaces 49 and beveled tips 37 reduce the likelihood of skiving of the projection 48 during insertion, thereby minimizing the removal of material from the projection 48. The distal portion of each projection 48 deforms and develops a retention force, but one that is localized, so that accumulation of stresses in the housing is avoided. The provision of a pair of opposed, substantially identical projections 48, equidistant from medial plane MP aids in close tolerance positioning of the contact terminal 28 along the medial plane MP.

One of the advantages of the terminal retention structure illustrated in FIG. 3 is believed to arise from the situation that after reflow to attach the solder ball 35 to the terminal 28, the terminal is secured in housing 20 in a locked condition under close to "zero clearance" conditions. This results from the following conditions. The terminal 28 is "bottomed" in passage 38 by inserting the terminal until bottom shoulders 33 engage passage bottom surfaces 39. This locates the terminal 28 in a vertical downward position, with respect to the view of FIG. 3. After reflow to attach the solder mass 35 onto tab 36, by techniques described, for example, in the previously noted Lemke et al. and Shuey patents incorporated by reference herein in their entireties, the solder ball and/or solder paste disposed in pocket 50 form a mass that fills and conforms to the shape of the pocket 50. Thus, the reflowed solder mass 35 serves to prevent movement of the terminal 28 upward (in the FIG. 3 sense) out of passage 38.

Figure 2:
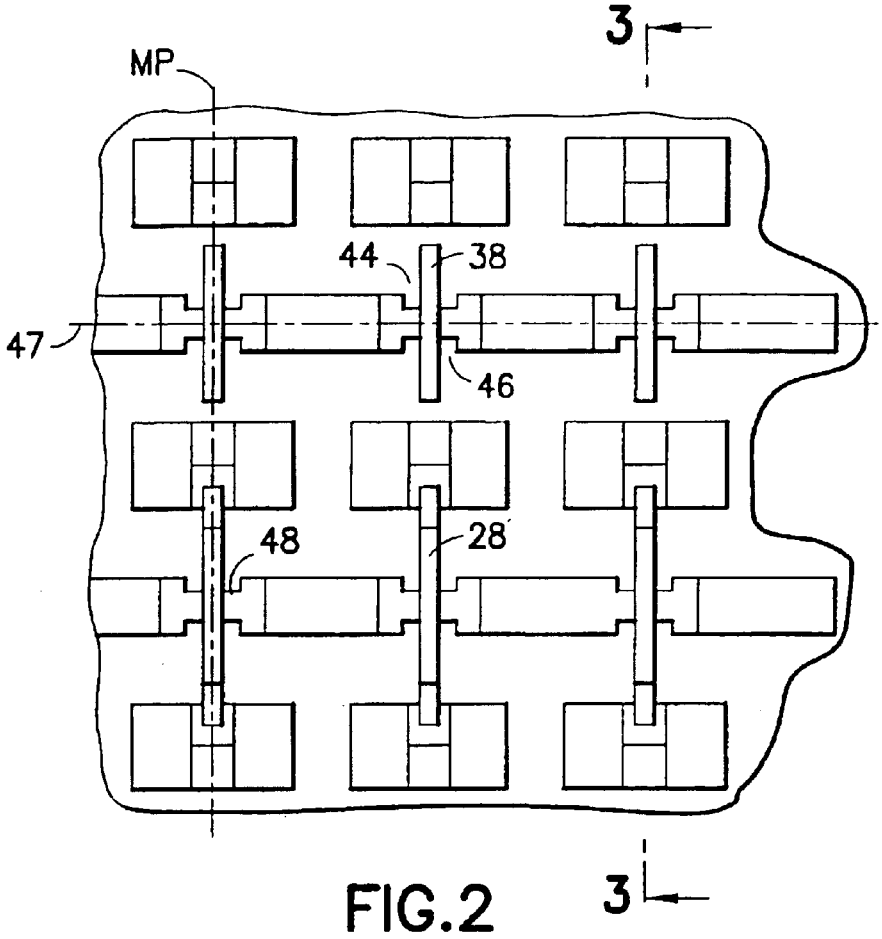
FIG. 2 is an enlarged view of the area A of the plug shown in FIG. 1.
Figure 4:
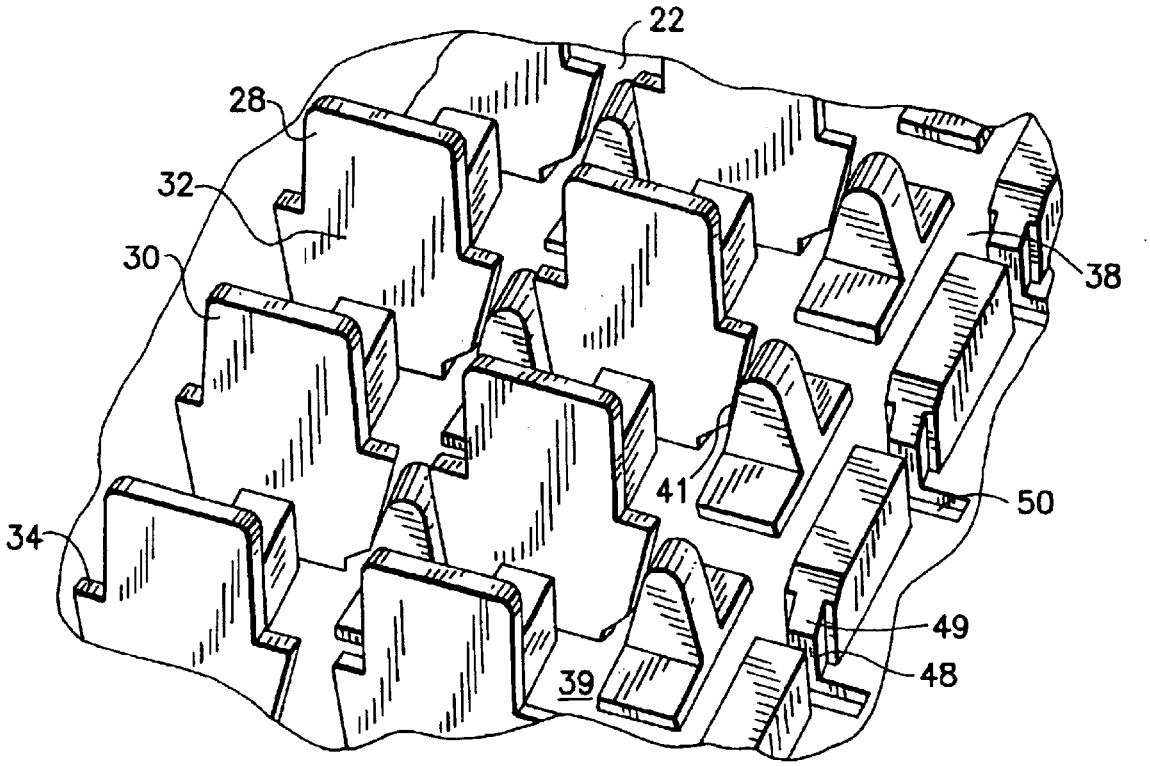
FIG. 4 is a partial perspective view of the plug area shown in FIG. 2.

The terminal 28 is located in side to side directions by engagement of side edges 43 of the retention section 32 against the lateral side walls 41 of the passage 38. Preferably side walls 41 and side edges 43 have a matching taper, as shown, to aid in true positioning of terminal 28. Turning to FIGS. 2 and 4, the terminal 28 is held centrally positioned within passage 38 (in the left to right directions in FIG. 2) by the opposed projections 48. This results in the location of terminal 28 in housing 22 under tolerance conditions that approach tolerances achieved in insert molding. The improved overall, achievable tolerance levels result from minimization of clearances that are normally present when metal terminals are post-inserted into a plastic housing. That is, positional tolerances are lessened, leaving fit tolerances (the tolerances between mating connectors) as the principal tolerance to be accommodated in the parts. The terminal pitch is maintained during insertion as if the terminals are still mounted on a carrier strip. The close pitch tolerance achieved during the terminal blanking operations is substantially maintained after terminal insertion, by employment of the contact retention system disclosed above.

While the cross sectional shape of the projections 48 shown in FIGS. 2 and 3 is preferred, projections or ribs of any suitable shape and size may be employed. The deformation of the projections 48 by the terminals 28 create frictional forces sufficient to hold the position of the terminals in the housing prior to reflow of the solder balls 35.

The configuration of the base 22 of the housing 20 in this embodiment differs from the Lemke et al and Shuey patents noted in the Background in that the connector base 22 has been thinned out to make room for the protection member 100 of this invention, which is included as part of the receptacle connector 72, to be describe later. The height of the terminal mating section 30 has been increased while the length of the retention section 32 has been decreased. Similarly, the side edges 43 of the retention section and the lateral side walls 41 of the passage 38 have been shortened. Even though the retention section 32 has been shortened as compared to the Lemke et al. and Shuey patents the projections 48 engaging the terminals 28 still create frictional forces sufficient to hold the position of the terminals in the housing prior to reflow of the solder balls 35. This results as previously noted in the location of terminals 28 in housing 22 under tolerance conditions that approach tolerances achieved in insert molding.

Adjacent each of the passages 38 are one or more tip receiving regions 44, 46 that are adapted to receive the distal portions of mating receptacle contact terminals 72. As shown, the recesses 44, 46 are formed with one side contiguous with the passages 38. In the embodiment shown in FIGS. 2–4, the recesses are on opposite sides of the medial plane MP. These recesses are also laterally offset from each other, that is, they are on opposite sides of a central plane 47 that is orthogonal to the medial plane MP.

Figure 12:
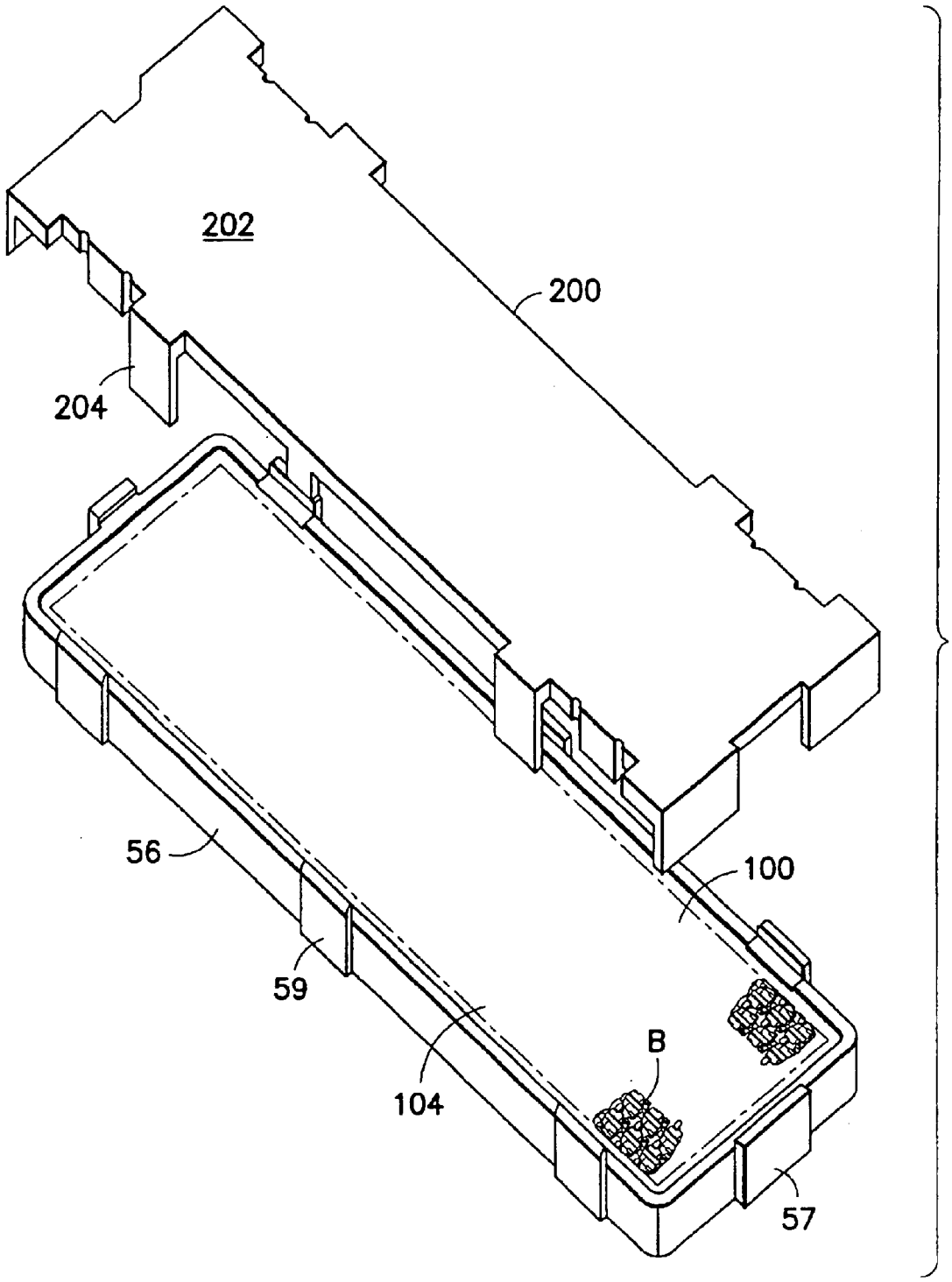
FIG. 12 is an exploded perspective view of a receptacle connector embodying the present invention and optional cover member.
Figure 13:
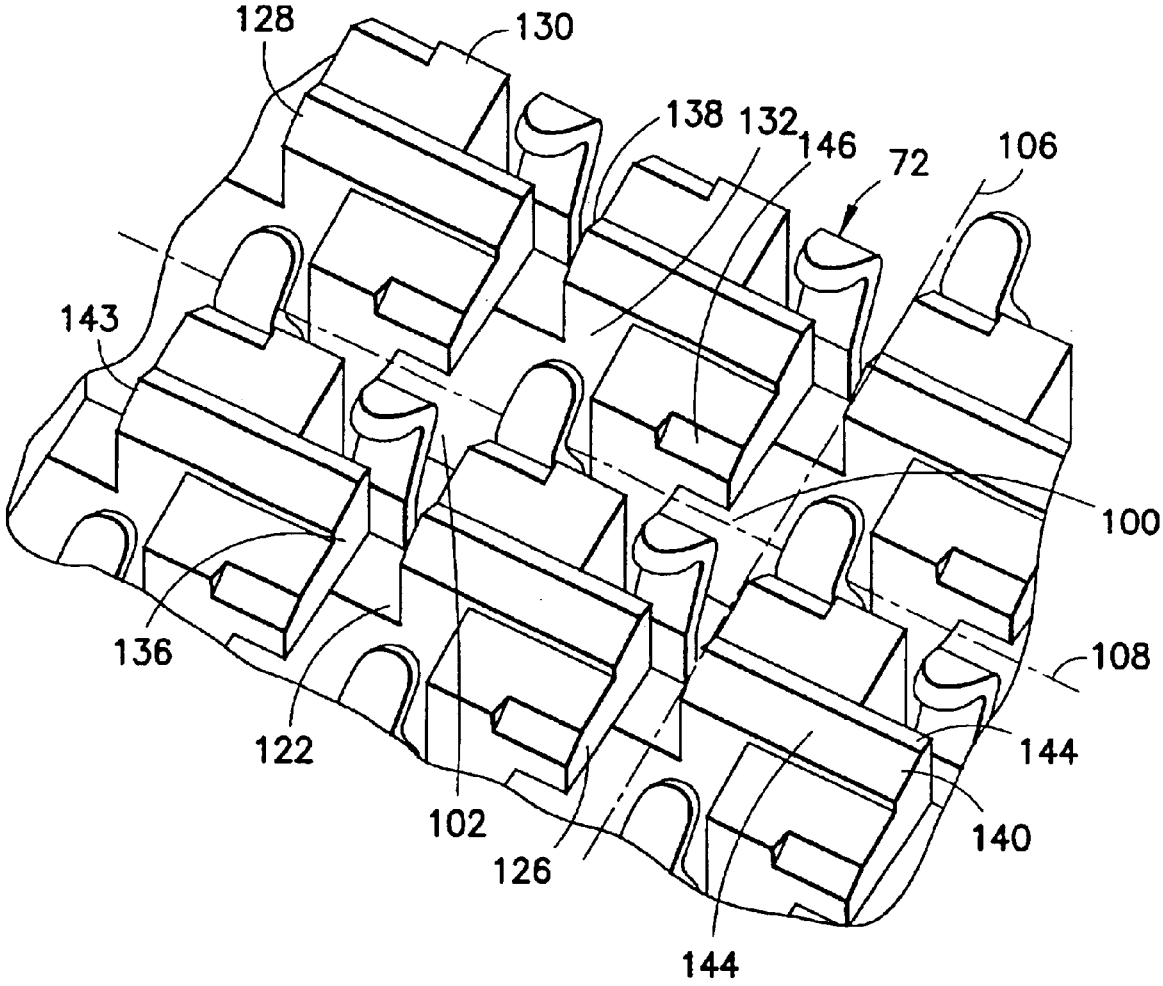
FIG. 13 is an enlarged perspective view of the area B of the plug shown in FIG. 12.
Figure 14:
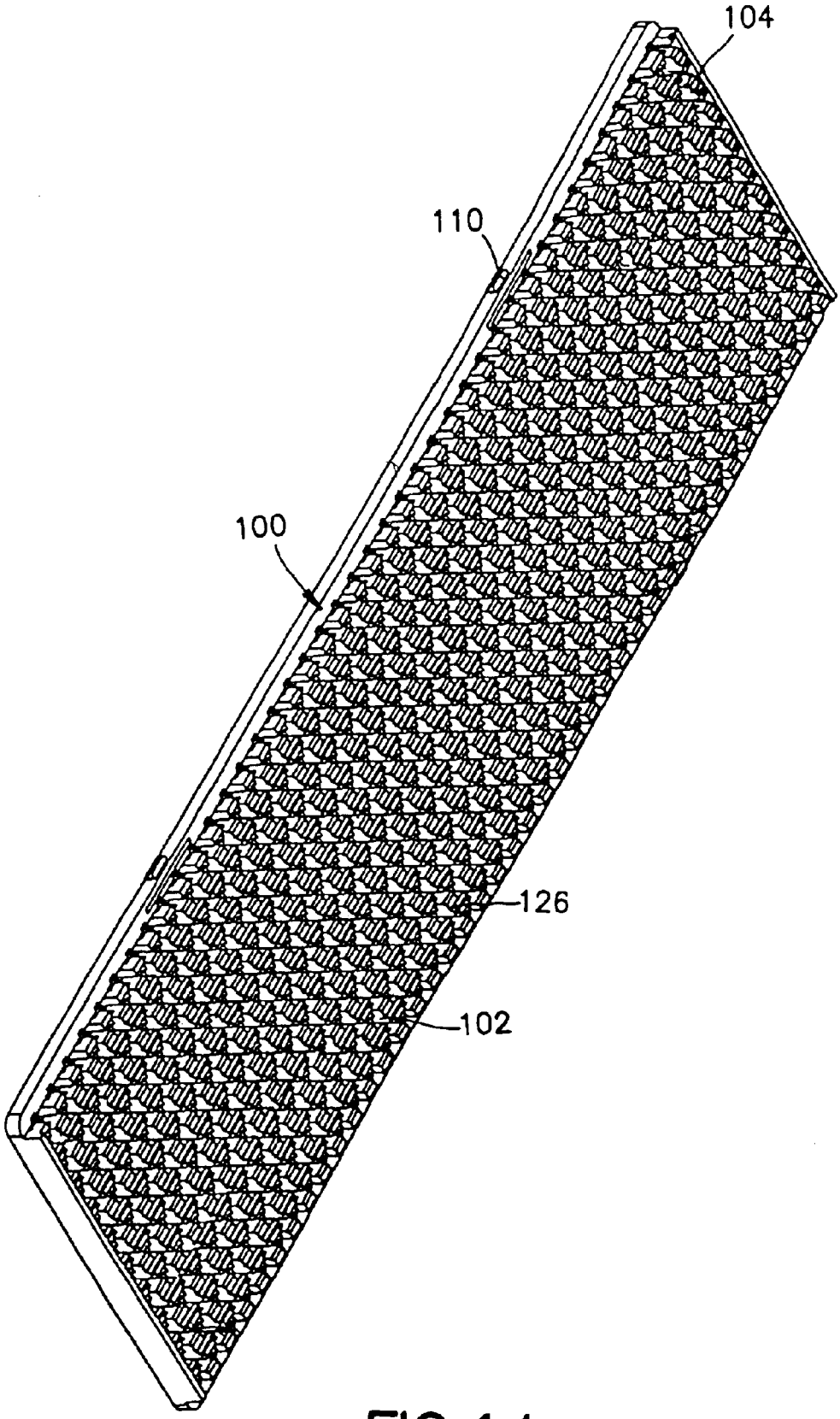
FIG. 14 is a perspective view of a protective member in accordance with a preferred embodiment of the invention.
Figure 15:
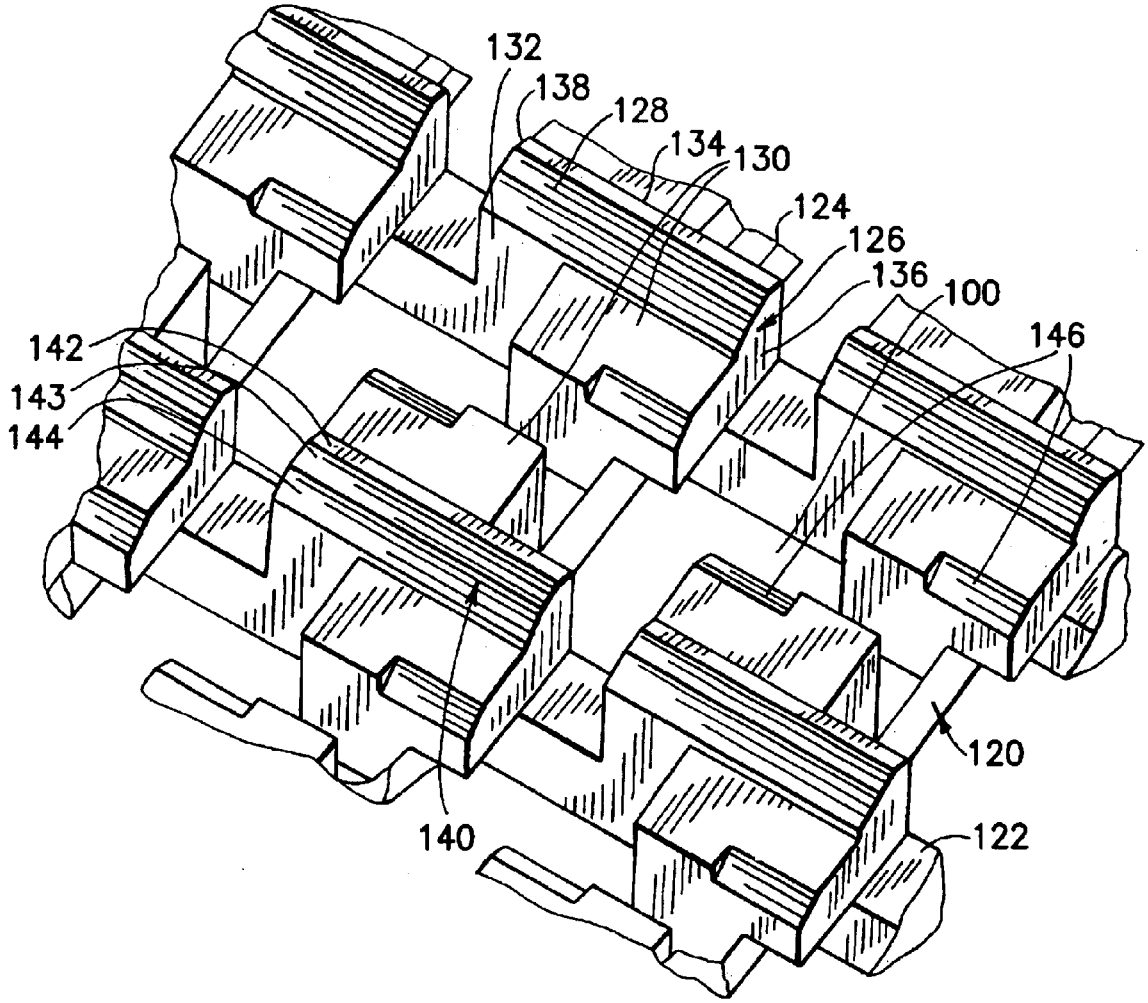
FIG. 15 is an enlarged partial perspective view of the protective member of FIG. 14.

Referring to FIGS. 1, 5, 6 and 12, a receptacle connector 52 in accordance with one embodiment of the invention for mating with the plug connector 20 is illustrated. The receptacle connector housing 52 includes a body or base member 54, preferably formed of the same insulative molded polymer as plug connector 20. Surrounding the base member 54 is a peripheral wall 56 formed as part of a unitary housing with said base member 54. If desired, the lateral wall 56 may be a separate element from the base member 54 and/or it can be made up of one or more segments. If desired it can include tabs 57 as in FIG. 12 for insertion into the polarizing/locating slots 26 of the plug connector 20. Alternatively, the slots 26 and tabs 57 can be reversed so that slots are located in the receptacle 52 wall 56 and the tabs are located in the plug 20 wall 24. Additional tabs 59 may be included in the peripheral wall 56 as shown in FIG. 12, which are arranged to slide in corresponding slots 61 as shown in FIG. 1, in the plug housing 20 peripheral wall 24. These additional tabs 59 and slots 61 help to guide the receptacle 52 into the plug housing 20 by keeping the receptacle 52 from cocking as it is inserted.

The base or body member 54 includes receptacle passages 62 for receiving of receptacle terminals 72. When utilizing receptacle terminals 72 of the type illustrated in FIGS. 5–9, the passages 62 preferably include opposed relief areas 64 for accommodating receipt of plug terminal 28 in the formed contact arms 78*a*, 78*b*. The relief areas 64 are preferably formed with lead-in surfaces 65 that extend and include the top portions of the projections 68. The passages 62 also include side walls 66. Opposed terminal retention projections 68 extend from the side walls 66 toward base sections 76 of the receptacle terminals 72. The projections 68 are deformed upon insertion of the receptacle terminals 72 in the same manner as described above with respect to the projections 48 in the plug connector 20. The chamfer 87 of tips 88 and lead-in surfaces 65 aid in achieving deformation rather than removal of the distal portions of the projections 68, as previously described in connection with FIG. 3.

Figure 5:
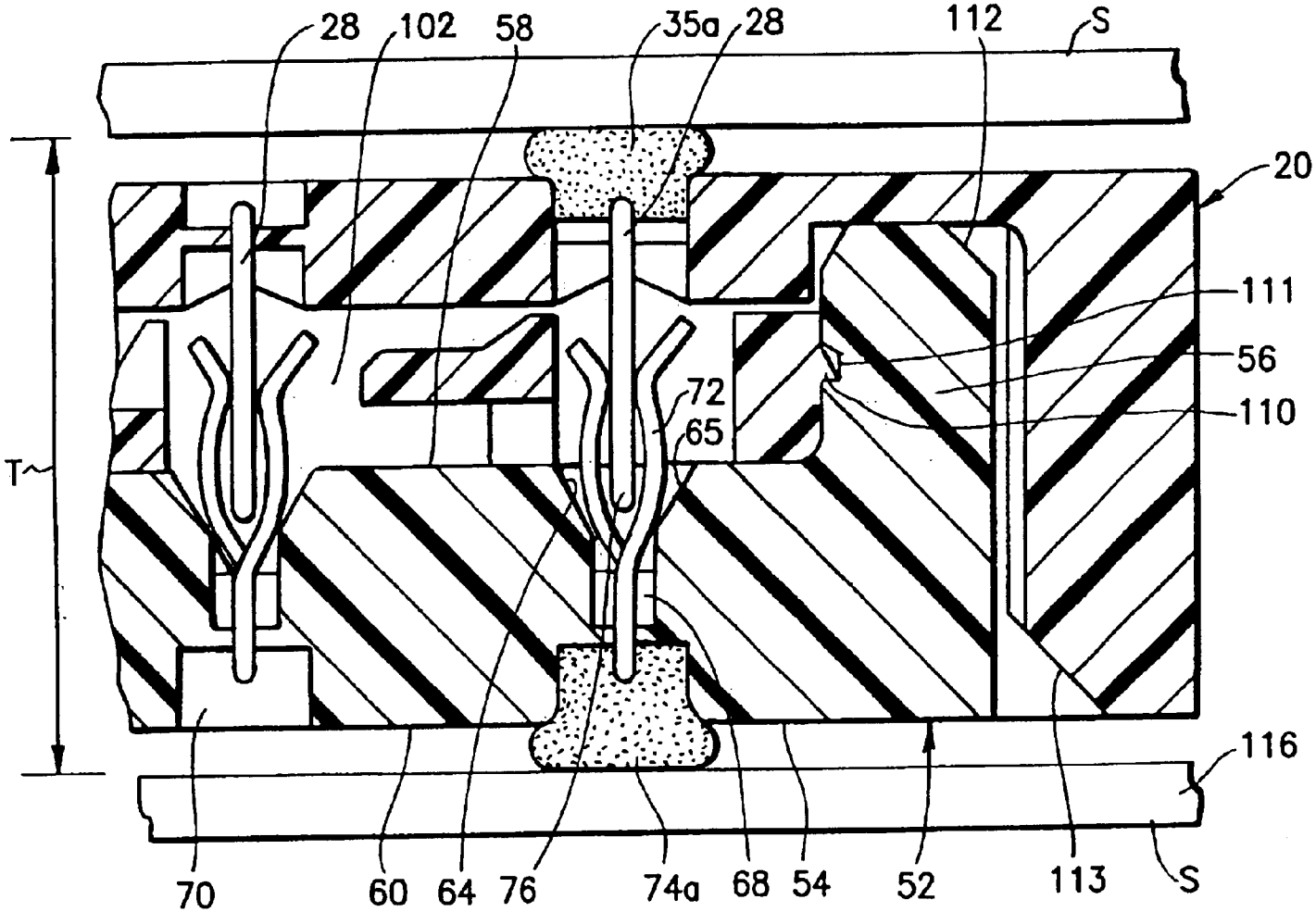
FIG. 5 is a partially cut away cross sectional view of the plug element shown in FIGS. 1–4 mated with a receptacle and mounted between stacked circuit substrates.
Figure 6:
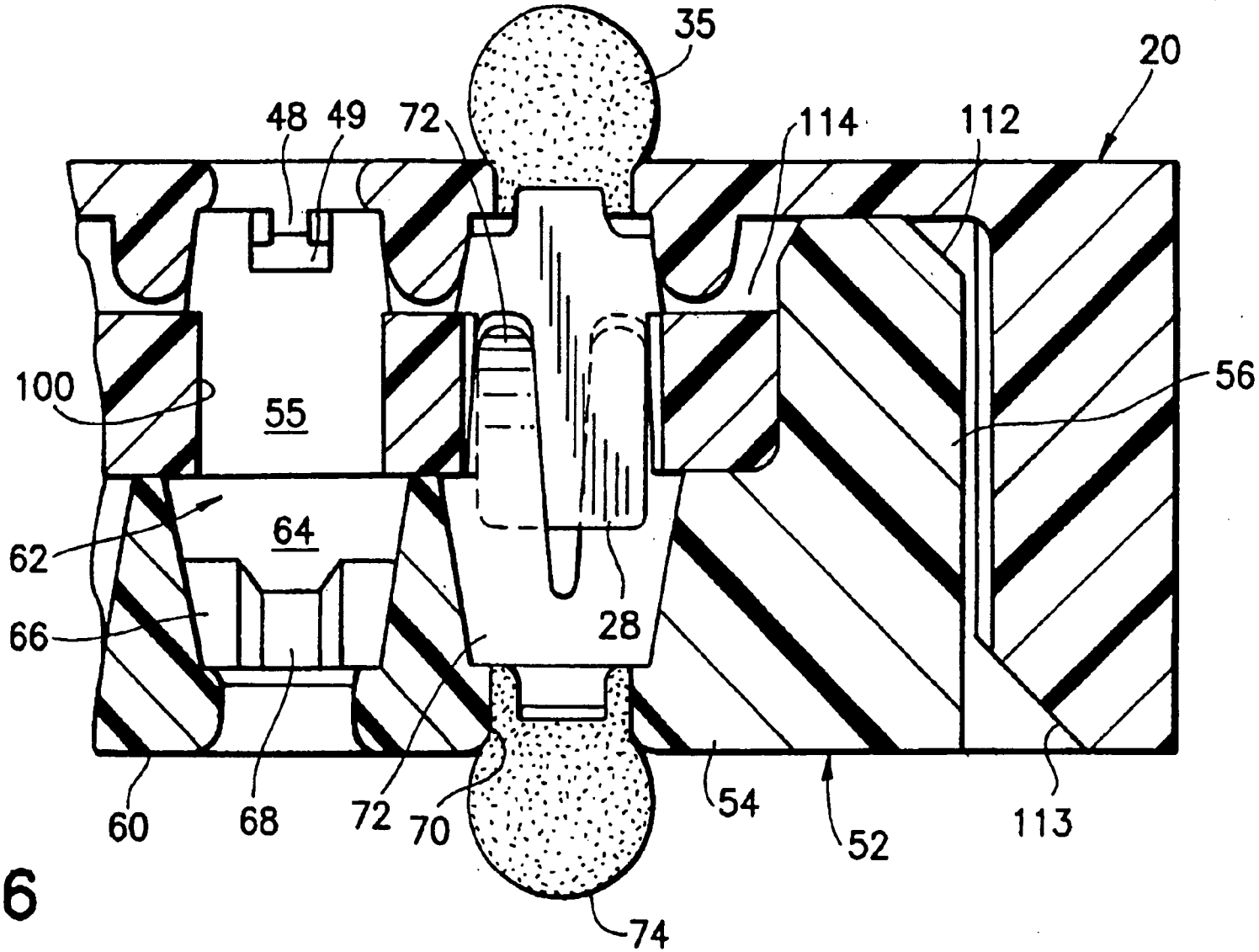
FIG. 6 is a partially cut away cross sectional view of the receptacle and plug shown in FIG. 5 in an orientation normal to that shown in FIG. 5.

Each receptacle passage 62 extends from the interface or surface 58 of body 54 to a well or pocket 70 formed in the mounting interface or surface 60. As shown in FIGS. 5 and 6, the pockets 70 are adapted to receive a substrate contact mass, such as solder balls 74 that are fused to the terminals 72 and substantially fill and conform to the shape of the pocket 70. Thus the receptacle terminals are retained and located substantially in the same manner as plug terminals 28.

As illustrated in FIGS. 5 and 6, the configurations of the plug and connector bodies 22 and 54 and the configurations of the plug contact terminals 28 and receptacle contact terminals 72 allow a low height for the mated connectors. This in turn allows the stacking height T between stacked circuit substrates S to be minimized after a second reflow of the solder balls 35*a* and 74*a*.

Figure 7:
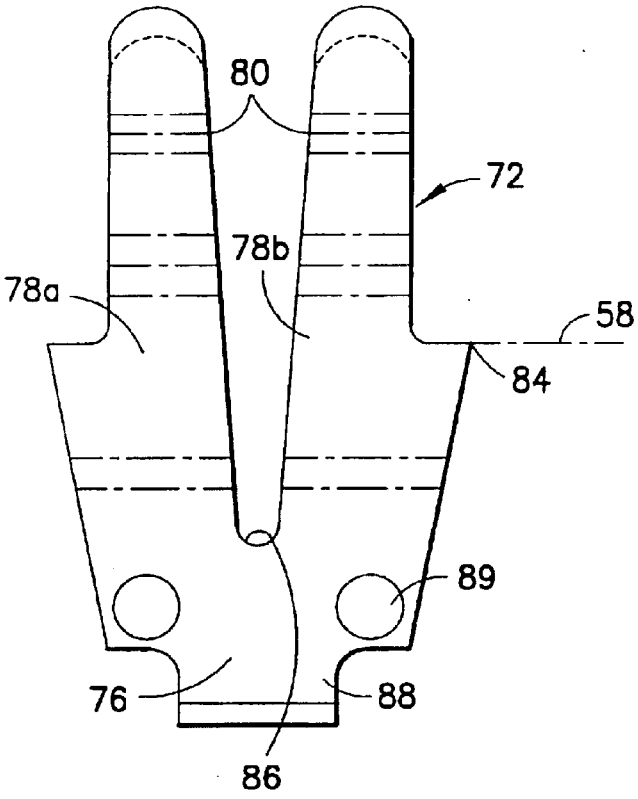
FIG. 7 is an elevational view of the receptacle contact terminal shown in FIGS. 5 and 6.
Figure 8:
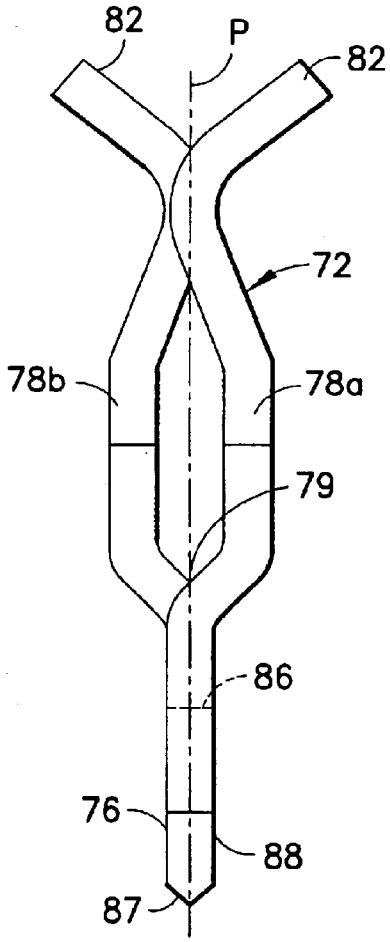
FIG. 8 is a side view of the receptacle contact terminal shown in FIG. 7.
Figure 9:
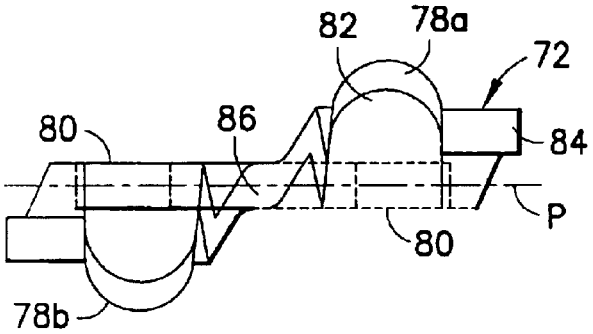
FIG. 9 is a top view of the receptacle contact terminal shown in FIGS. 7 and 8.

Turning now to FIGS. 7–9, the receptacle terminal 72 is described in further detail. Each receptacle contact terminal includes a base portion 76 and a pair of cantilevered spring contact arms 78*a*, 78*b*. As shown in FIG. 9, the base portion 76 is substantially planar and can be considered as defining a longitudinally extending central plane P of the contact. As shown in FIG. 9, each of the contact arms 78*a*, 78*b* diverges oppositely from the plane P in the central region of the contact arms to form between them a bight 79, which is spaced from the bottom 86 of the gap located between the two contact arms The distal portions of the arms 78*a*, 78*b* then converge toward the plane P to form contact sections 80 for engaging the plug terminals. Lead-in portions 82 are formed at the ends of the arms 78*a*, 78*b* to aid in mating with the plug contact 28. A sharp shoulder 84 is formed intermediate the ends of each of the arms 78*a*, 78*b*. The sharp shoulder acts as a barb to aid in retention of the terminal within the passage 62. These shoulders, as well as the shoulders 34 of plug contacts 28 are engaged by tooling to insert the metal contacts into the respective plastic bodies. The sharp corners aid in retaining the terminals in the respective passages.

The use of the laterally offset contact arms 78*a*, 78*b* provides numerous advantages including minimization of the front-to-back dimension of the terminal, even when deflected by the entry of the plug contact 28 between the two arms 78*a*, 78*b*. Further, the utilization of the terminal retention projections 68 as shown in FIGS. 5 and 6 allows a maximization of the length of the contact arm 78*a*, 78*b* thereby allowing the development of suitable amounts of deflection to generate appropriate contact normal forces and sufficient contact wipe.

As shown in FIG. 8, a solder tab 88 projects from the base section 76. In a preferred form, the solder tab 88 is adapted to have a solder ball fused onto it. As previously discussed in connection with plug terminal 28, the leading edge of the terminal 72 is provided with appropriate lead-in structure, such as chamfered surfaces 87. The base section may be provided with thermal break structure to minimize solder wicking from the pocket 70 onto the terminal. As shown in FIG. 7, the thermal break structure can comprise a pair of openings 89. This structure may be used in conjunction with the formation of a passivated surface on base section 76 or the application of other appropriate conventional anti-solder wicking or masking coatings, such as organo-fluoro polymers as are known in the art. The thermal breaks, with or without passivation and/or anti-wicking or solder masking coatings, retard the flow of solder along the contact, when solder paste in pocket 70 is reflowed to secure the solder ball 74 on the solder tab 88. The plug terminal 28 may also include such anti-solder wicking or masking adjuncts as thermal breaks, passivation, coatings or any desired combination thereof.

Figure 10:
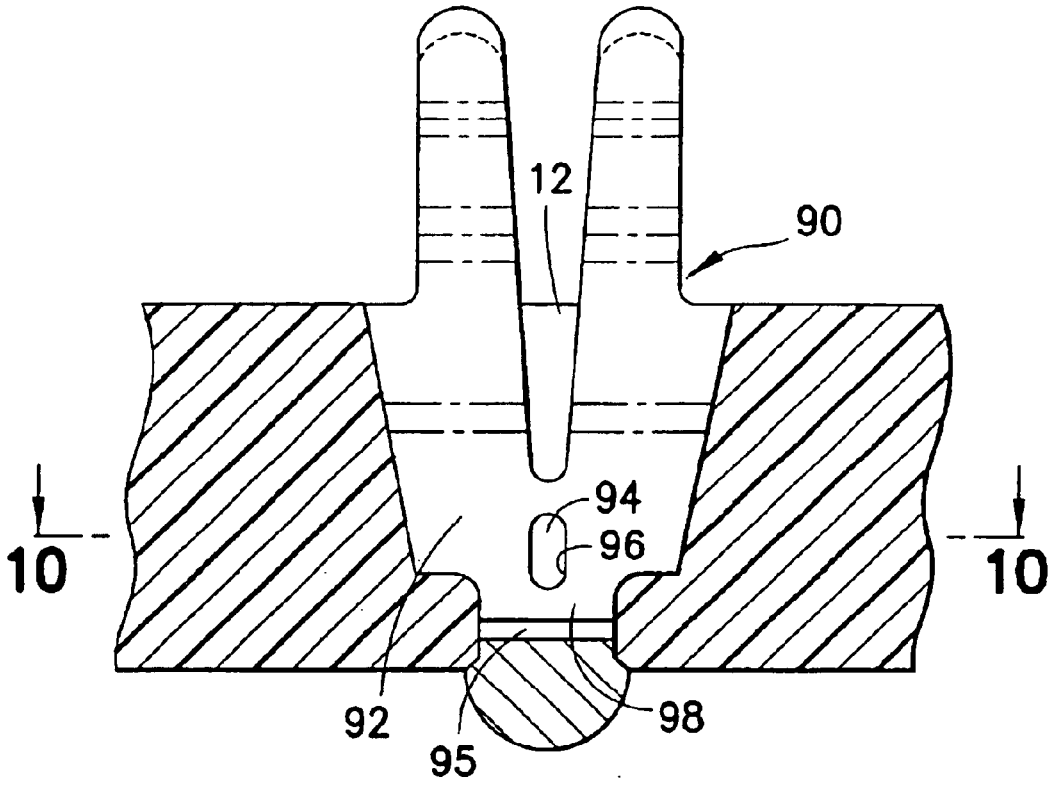
FIG. 10 is an elevational view of a second embodiment of the receptacle contact terminal.
Figure 11:
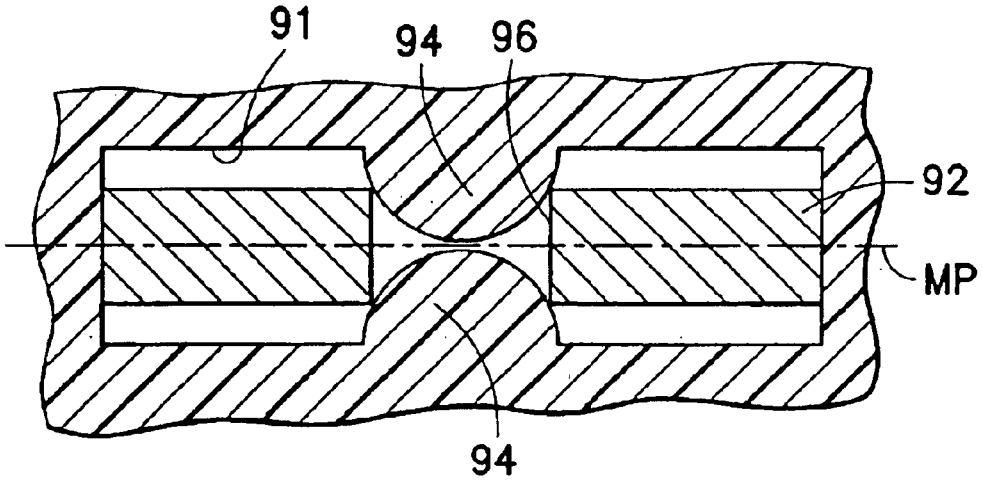
FIG. 11 is a cut away cross sectional view along line 10—10 of FIG. 10 of the retention section of the contact terminal retained in a passage.

Referring to FIGS. 10 and 11, an alternative structure is shown for retaining terminals, such as the receptacle contact terminals 90 in a connector housing. In this embodiment, passages 91 are formed to receive the terminals 90. Within each of the passages 91, one or more projections 94 are formed to extend from the side walls of the passage. Each terminal has an opening 96 that is sized and shaped to receive at least a portion of one or both of the projections 94. Ideally, the shape of the opening 96 corresponds to the shape of the projections 94, so that the terminal is constrained by the projections against sideways and longitudinal movement, as well as front to back movement. The distal portions of the projections 94 are spaced apart a distance less than the thickness of the material from which the terminal 90 is formed and preferably equidistant from the medial plane MP.

Upon insertion of the terminal 90 into the passage 91, the projections 94 are deformed or spread slightly by the terminal tip or solder tab 98. The beveled or chamfered surface 95 reduces the tendency of the solder tab 98 to skive the distal portions of the projections 94. When the terminals are in a fully inserted position, the projections 94 are aligned with the opening 96 and the distal portions thereof enter the opening 96. As a result, any stress imparted on the connector body is localized to the distal regions of the projections 94. Because a significant portion of the stress is relieved when the projections 94 enter opening 96, there is avoidance of stress build up that could cause warpage or bowing of the connector body. Preferably, the longitudinal cross section of retention section 92 is substantially symmetrical about a central longitudinal plane, so that there is a self-centering action imposed on the contact terminal 90 as the base 92 is inserted into the passage 91. The opening 96 also can function as a thermal break to retard solder wicking, in the same manner as openings 89 in the FIGS. 7–9 embodiment. The terminal 90 may also include passivation or anti-wicking coatings to prevent solder flow toward the contact sections.

The receptacle connector 52 described above is similar in most respects to the one disclosed in U.S. Pat. No. 6,241,535 which has been incorporated by reference in its entirety herein. While this receptacle connector 52 represents a preferred embodiment of this invention, the invention is applicable to a wide variety of high density connectors, particularly low profile connectors.

In accordance with an embodiment of the invention, a high density connector comprises plug housing 20 as in FIGS. 1–6 and a receptacle housing as in FIGS. 5–15. The receptacle housing 52 has a base wall 54 and at least one lateral wall 56 defining a cavity 55. The lateral wall 56 is configured to nest within the plug housing 20. A high density array of female electrical contacts 72 is arranged in the cavity 55. The contacts 72 are supported in the base wall 54 and extend unsupported above the base wall to a given height. This invention is adapted to protect such unsupported contacts 72 from being bent or misaligned during handling prior to the connection of the receptacle 52 to the plug 20.

In accordance with an embodiment of this invention, such protection is provided by at least one protection member 100, which is arranged in the cavity 55 adjacent the interface 58. Preferably the protection meter is a single piece member. The protection member 100 has an array of openings 102 into which the electrical contacts 72 extend. The protection member 100 has a thickness selected so that the electrical contacts 72 do not extend generally beyond an outer most surface 104 of the protection member.

The protection member 100 may have from about 100 to about 400 or more openings 102 arranged in an array comprising a plurality of rows 106 and columns 108 in correspondence with the array of contacts 72 in the receptacle member 52. The electrical contacts 72 deflect upon insertion of a corresponding male contact 28 of the plug housing 52 and therefore the openings 102 are configured to permit full operation of the contacts including such deflection. The protection member 100 generally comprises a single piece plate like member which is arranged in contact with the base member or surface 54.

At least one portion 110 of the protection member 100 is adapted to secure the protection member 100 within the cavity 55. The at least one portion 110 of the protection member 100 preferably comprises a tab 110 adapted to snap fit into a slot 111 in the lateral wall 56 of the receptacle 52 such as into a recess in the wall (not shown). Alternatively the lateral wall 56 could include a latch projection (not shown) within the cavity 55 for engaging the tab portion 110 of the protection member 100 to secure the protection member 100 to the receptacle 52. Preferably a plurality of portions 110 are arranged about the periphery of the protection member and at least along both long sides thereof.

The connector 20 and 52 of this invention is capable of operation without the protection member. The at least one lateral wall 56 of the receptacle 52 preferably includes at a free edge thereof a guide surface 112 which interacts with the guide surface 113 of the plug housing 20 for guiding the receptacle housing into the cavity 114 of the plug housing 20 as shown in FIGS. 5 and 6.

The lateral wall 24 of the plug housing is configured to receive the lateral wall 56 of the receptacle housing 52 in a nested configuration. When the receptacle housing 52 is nested in the plug housing 20 the male contacts 28 are engaged by respective female contacts 72. As previously described the lateral wall 56 of the receptacle 52 includes a plurality of projections 59 from the outside of the wall which extend transverse to a plane of the base wall 54 of the receptacle housing. Similarly, the lateral wall 24 of the plug housing 20 includes a corresponding plurality of slots 61 internally of the cavity 114 for receiving the projections 59.

In use for example, as shown in FIG. 5, the receptacle housing 52 is mounted to a first circuit board 116 and the plug housing 20 is mounted to a second circuit board 118 so that the connector provides a low profile electrical connection between the circuit boards 116 and 118.

Referring now to FIGS. 12 to 15, the protection member 100 will be described in greater detail. The protection member 100 comprises a support lattice 120 comprising beams 122 in the column direction and cross beams 124 in the row direction. The beams 122 are arranged generally perpendicular to the beams 124 to form the lattice 120. The beams 122 are arranged so that when the protection member 100 is attached to the receptacle 52 the beams 122 lie between columns 108 of contacts 72. The beams 124 are arranged so that when the protection member 100 is attached to the receptacle 52 the beams 124 lie between rows 106 of contacts 72. At respective intersections of the beams 122 and beams 124 an unitary and integral projection 126 is provided. From the top view the projections have an "S" like shape comprised of an elongated central portion 128 and a side portion 130 arranged on each side 132, 134 of the central portion 128. The side portion 130 on the side 132 of the central portion 128 is staggered relative to the side portion 130. The length of the side portions 130 is less than the length of the central portion 128. The staggering is obtained by having one of the side portions 130 on the side 132 of the central portion 128 extend from a first end 136 of the central portion 128 and the other of the side portions 130 on the other side 134 of the central portion extend from an opposing end 138 of the central portion.

The outer or top surface 140 of the central portions 128 has a series of three parallel longitudinal sections 142, 143, and 144. The central section 143 is the highest surface of the protection member 100 and in use it is at about equal to the height of the contacts 72 in the receptacle 52. The surfaces 142 and 144 on either side of the central surface 143 slope away from the central surface 143 toward the beams 122 and 124. The side portions 130 of the projections 126 include a chamfered portion 146 to aid in guiding the terminal 28 into engagement with the contacts 72.

Each of the openings 102 are defined by the void formed between the four projections 126 surrounding the opening. The openings 102 also form an "S" shape so that the contacts 72 are free to deflect as a male terminal 28 from the plug connector 20 are inserted into engagement with the contacts 72.

Referring to FIG. 12 an optional cover 200 may be used to cover the receptacle housing 52 to prevent dirt or dust from entering the receptacle before use. The cover 200 comprises a top member 202 and friction tabs 204 arranged about the periphery of the top member 202 for engaging the peripheral wall 56 of the receptacle 52 to frictionally hold the cover in place over the terminals 72 and protection member 100. If desired the cover could be held in place by a snap connection or any other conventional means.

While the present invention has been described in connection with the preferred embodiments of the various figures, it is to be understood that other similar embodiments may be used or modifications and additions may be made to the described embodiment for performing the same function of the present invention without deviating therefrom. Further, the arrangements described can be used with respect to components other than connectors, that comprise housings formed of insulative materials which carry elements to be fused onto a PWB or other electrical substrate.

Therefore, the present invention should not be limited to any single embodiment, but rather construed in breadth and scope in accordance with the recitation of the appended claims.

What is claimed is:

1. A high density connector comprising:

a receptacle housing having a base wall and at least one lateral wall defining a cavity, said lateral wall being configured to nest within a plug housing of a mating electrical connector;

a high density array of female electrical contacts arranged in said cavity, said contacts being supported in said base wall and extending unsupported above said base wall to a given height;

a single piece protection member arranged in said cavity adjacent said base wall, said protection member having a support lattice and an array of openings in which said electrical contacts extend; and said protection member having a thickness selected so that said electrical contacts do not generally extend beyond an outer most surface of said protection member, and wherein said protection member is located within said cavity of said receptacle housing and has a connection between said protection member and said receptacle housing, wherein said connection comprises a snap-lock connection inside said cavity directly between portions of said protection member and said receptacle housing, and wherein said protection member is housed inside said cavity and directly fixedly and stationarily attached to said receptacle housing inside said cavity to protect said electrical contacts before connection of the high density connector to the plug housing of the mating connector.

2. The high density connector as in claim 1 having from about 100 to about 400 or more openings in said array of openings, said array of openings comprising a plurality of rows and columns of said openings.

3. The high density connector as in claim 1 wherein said connector is capable of operation without said protection member.

4. The high density connector as in claim 1 wherein said protection member is substantially planar and said connection comprises a projection or recess at side ends of said protection member.

5. The high density connector as in claim 1 wherein said openings in said protection member comprise a general "S" shape.

6. The high density connector as in claim 1 wherein said protection member comprises upper projections at each of said openings, and wherein said upper projections are located at least partially between said openings.

7. The high density connector as in claim 6 wherein said projections comprise central portions with sloped surfaces which are sloped away from a highest surface of the projections.

8. The high density connector as in claim 1 wherein said electrical contacts deflect upon insertion of a corresponding male contact of said plug housing and said openings are configured to permit full operation of said contacts including said deflection.

9. The high density connector as in claim 8 wherein said protection member comprises a plate like member which is arranged in contact with said base wall.

10. The high density connector as in claim 9 wherein said snap-lock connection is located within said cavity.

11. The high density connector as in claim 10 wherein said snap-lock connection comprises a tab on said protection member which is snap fit into said lateral wall of said receptacle housing.

12. The high density connector as in claim 11 wherein said at least one lateral wall includes at a free edge thereof a guide surface for guiding said receptacle housing into a cavity of said plug housing.

13. An electrical connector assembly comprising:

a high density connector as in claim 12; and the mating electrical connector comprising:

the plug housing having a base wall and at least one lateral wall defining the cavity, said lateral wall of said plug housing being configured to receive said lateral wall of said receptacle housing in a nested configuration;

a high density array of male electrical contacts arranged in said plug housing cavity, said male contacts being supported in said base wall of said plug housing and extending unsupported above said base wall to a desired height;

wherein said male contacts are engaged by said female contacts.

14. The electrical connector assembly as in claim 13 wherein said receptacle housing is mounted to a first circuit board and said plug housing is mounted to a second circuit board so that said connector provides a low profile electrical connection between said circuit boards.

15. The electrical connector assembly as in claim 13 wherein said lateral wall of said receptacle includes a plurality of projections from the outside of said wall, said projections extending transverse to a plane of said base wall of said receptacle housing; and wherein said lateral wall of said plug housing includes a corresponding plurality of slots internally of said cavity for receiving said projections.

16. A high density connector comprising:

a receptacle housing having a base wall and at least one lateral wall defining a cavity, said lateral wall being configured to nest within a plug housing;

a high density array of female electrical contacts arranged in said cavity, said contacts being supported in said base wall and extending unsupported above said base wall to a given height;

a single piece protection member arranged in said cavity adjacent said base wall, said protection member having an array of openings in which said electrical contacts extend; and said protection member having a thickness selected so that said electrical contacts do not generally extend beyond an outer most surface of said protection member, and wherein said protection member is located within said cavity of said receptacle housing and has a connection between said protection member and said receptacle housing which comprises said protection member being directly fixedly attached to said receptacle housing inside said cavity; wherein said protection members comprise upper projections comprising a general "S" shape.

17. A high density connector comprising:

a receptacle housing haying a base wall and at least one lateral wall defining a cavity;

female electrical contacts connected to said receptacle housing and extending into said cavity; and a protection member connected to said receptacle housing inside said cavity, said protection member comprising a support lattice with a plurality of openings into which said electrical contacts extend, wherein a stationary connection between said protection member and said receptacle housing is provided which comprises said protection member being directly fixedly and stationarily attached to said receptacle housing inside said cavity, wherein said protection member comprises upper spaced projections adjacent each of said openings, and wherein said upper projections are located at least partially between said openings.

18. A high density connector as in claim 17 wherein said stationary connection comprises a snap lock connection between said protection member and said receptacle housing inside said cavity.

19. A high density connector as in claim 18 wherein said snap lock connection comprises a snap lock connection between an outer side edge of said protection member and an inner side of said at least one lateral wall of said receptacle housing.

* * * * *